US006641066B2

(12) United States Patent
Kamiya

(10) Patent No.: US 6,641,066 B2
(45) Date of Patent: Nov. 4, 2003

(54) FILTER SYSTEM FOR ENVIRONMENTALLY-SAFE PORTABLE APPARATUS FOR DISPOSING OF CYLINDRICAL LIGHT BULBS

(76) Inventor: Kazuo Kamiya, 1-17-8 Ebisunishi, Shibuya-ku, Tokyo-to (JP)

( * ) Notice: Subject to any disclaimer, the term of this patent is extended or adjusted under 35 U.S.C. 154(b) by 72 days.

(21) Appl. No.: 09/775,317

(22) Filed: Feb. 1, 2001

(65) Prior Publication Data

US 2001/0025895 A1 Oct. 4, 2001

(30) Foreign Application Priority Data

Mar. 22, 2000 (CA) ..... 2301958

(51) Int. Cl.[7] ..... B02C 13/16; B02C 19/14

(52) U.S. Cl. ..... 241/47; 241/79.1; 241/99; 241/100; 241/194; 241/DIG. 38

(58) Field of Search ..... 241/47, 79.1, 99, 241/100, DIG. 14, DIG. 38, 193, 194, 197

(56) References Cited

U.S. PATENT DOCUMENTS

| | | | | |
|---|---|---|---|---|
| 3,623,672 A | | 11/1971 | De Frank | |
| 3,913,849 A | | 10/1975 | Atanasoff et al. | |
| 4,579,287 A | | 4/1986 | Brown | |
| 4,655,404 A | | 4/1987 | Deklerow | |
| 5,205,497 A | | 4/1993 | Deklerow | |
| 5,586,730 A | * | 12/1996 | Mortrud | 241/100 |
| 5,660,338 A | | 8/1997 | Emmerson | |
| 5,769,336 A | | 6/1998 | Emmerson | |
| 5,884,854 A | * | 3/1999 | Månsson et al. | 241/19 |
| 5,899,395 A | * | 5/1999 | Deklerow | 241/100 |
| 5,944,268 A | * | 8/1999 | Andela | 241/99 |
| 6,032,883 A | * | 3/2000 | Hansen | 241/24.3 |
| 6,039,277 A | * | 3/2000 | Hamm et al. | 241/189.1 |

FOREIGN PATENT DOCUMENTS

| | | |
|---|---|---|
| CA | 1185946 | 5/1982 |
| CA | 1188283 | 10/1982 |
| CA | 1215959 | 7/1984 |
| CA | 1293234 | 6/1987 |

* cited by examiner

*Primary Examiner*—John M. Husar
(74) *Attorney, Agent, or Firm*—D. Peter Hochberg; Katherine R. Vieyra; Sean Mellino

(57) ABSTRACT

A portable unitary apparatus, preferably wheeled, is provided herein for disposing of hazardous light bulbs, e.g., fluorescent light bulbs. The apparatus is in the form of a housing which includes an upper compartment, and a lower compartment. The top of the housing is provided with a cylindrical fluorescent light bulb feed chute for a fluorescent light bulb to be disposed of. A rotary, bulb crushing fluorescent light bulb device, comprising a pair of rigid articulated crushing hammers is secured to opposed ends of a securement member, by means of a chain-type joint, each rigid articulated crushing hammer including an arm and a weighted end, the weighted end being secured to the end of an associated arm by a chain-type joint. The rigid articulated crushing hammers which are powered by a motor, are disposed within an enclosed reduction chamber shroud which depends from the upper compartment. A disposable, pulverized fluorescent light bulb collection bag is selectively disposed within the lower compartment in air-sealed relationship to the reduction chamber. A filter system is disposed within the upper chamber. This filter system includes exhaust tubes which are connected between the reduction chamber and the fluorescent light bulb feed chute, and is constructed to draw noxious vapors through three filters arranged in series by means of a vacuum generator. The vapors pass through primary, secondary and tertiary filters and then into the reduction chamber shroud, where a portion of the vapors is recycled through the filters again, while the rest of the vapors accompany the disintegrated glass into the disposable bag. Thus, any trace amount of vapors which may be discharged into the ambient environment are environmentally-clean. A weigh scale means may also be provided to prevent overfilling of the disposable bags.

22 Claims, 5 Drawing Sheets

FILTER SYSTEM FOR ENVIRONMENTALLY-SAFE PORTABLE APPARATUS FOR DISPOSING OF CYLINDRICAL LIGHT BULBS

BACKGROUND OF THE INVENTION (a) Field of the Invention

This invention relates to an apparatus for disintegrating light bulbs, more particularly, cylindrical fluorescent bulbs and for simultaneously providing a holding unit to contain such disintegrated cylindrical fluorescent lamps in an environmentally-safe manner.

(b) Description of the Prior Art

Fluorescent bulbs are mercury-vapor electric-discharge lamps, in which the inside of the bulb or tube is coated with fluorescent material so that ultra-violet radiation from the discharge is converted to light of an acceptable colour. Such lamps take advantage of fluorescence, which is the production of visible light (white or coloured) or other radiation by a substance as the result of exposure to, and absorption of, other radiations of different wave length, such as ultraviolet light, or electric discharge in a vacuum tube. Those substances having this property are known as phosphors, the term usually being restricted to those solids that absorb ultraviolet and emit visible light. In ordinary fluorescent lighting, the tube contains mercury vapor and argon, and the inside walls of the tube are coated with the fluorescent substance, often a zinc or cadmium compound. The passage of an electric current through the mercury vapor-argon mixture produces invisible ultraviolet light which is absorbed by the phosphor and is re-emitted as visible light. The whole process occurs at a relatively low temperature (hence called a "cold light" process).

Among the numerous substances which are known to exhibit phenomenon of fluorescence may be mentioned fluorite, uranium glass, petroleum, solutions of certain organic dyestuffs, eosin, fluorescein, quinine sulfate, chlorophyll, and the vapors of sodium, mercury, iodine, and acetone.

Because of the contents of such fluorescent bulbs, their disposal brings about environmental concerns, particularly where such fluorescent bulbs are commonly disposed of with the everyday trash. It would therefore be desirable to provide a system for safely disintegrating such fluorescent lamps.

There are many known compacting-type devices for crushing these fluorescent bulbs. Those devices mostly consist of sealed housings. A cylindrical feed tube is provided to feed fluorescent light bulbs vertically into the housing through the top surface of the housing. Inside the housing, a hammer is symmetrically installed on a motor shaft on its right and left sides. The hammer is rotated by a motor, and crushes the fluorescent light bulbs. The crushed materials are dropped and collected in a bag, while hazardous gases, e.g., mercury vapor, which is released from the crushed fluorescent light bulbs, is discharged into the air from the sealed housing after being filtered and processed to be not harmful.

Various patented arrangements have been proposed for breaking up fluorescent light bulbs into small pieces. Most of these, particularly the arrangements therein for preventing escape of phosphorus and mercury vapors which are present in fluorescent light bulbs, are complicated, requiring vacuum or pressure pumps and the like for their operation. Among the patented arrangements are those disclosed by the following patents:

U.S. Pat. No. 3,623,672 patented November 1971 by W. de Frank; U.S. Pat. No. 3,913,849 patented Oct. 31, 1975 by I. M. Atanasoff et al; U.S. Pat. No. 4,579,287 patented Apr. 1, 1980 by W. E. Brown; U.S. Pat. No. 4,655,404 patented Apr. 7, 1987 by J. W. Deklerow; U.S. Pat. No. 5,205,497 patented Apr. 27, 1993 by J. W. Deklerow; U.S. Pat. No. 5,660,338 patented by Dana Emmerson on Aug. 27, 1997; U.S. Pat. No. 5,769,336, patented Jun. 23, 1998, by Dana Emmerson; Canadian Patent No. 1,185,946 issued Apr. 23, 1985 to D. F. Green; Canadian Patent No. 1,188,283, issued Jun. 4, 1985, by J. W. Deklerow; Canadian Patent No. 1,215,959 issued Dec. 30, 1986 to J. Mordstein et al; and Canadian Patent No. 1,293,234, issued Jun. 8, 1987 to E. Karg.

Each of such devices has problems in the structure and durability of its rotating crushing device. Typically there have been two types of crushing devices: one that has a set of symmetrical rigid arms; and one that consists of a pair of assemblies made up of wire with a weight on its both tips and which rotates symmetrically on a motor shaft. Fluorescent light bulbs have metal pieces on both ends. When the prior art crushing device is used to crush fluorescent light bulbs, its arms could hit the metal ends and be damaged. Furthermore, the impact may cause the arms to reverse the direction of rotation, and that may lead to overheating of the motor. When the prior art crushing device is used and one of the wired weights hits the metal ends of fluorescent light bulbs, the symmetrical balance of the crushing device is lost and could cause vibration to the motor. Such vibration may be amplified to cause the entire unit to vibrate, and thus may cause the housing, that is generally made of plastic, to crack. In addition, the connecting point of the wire and weight is likely to break off due to metal fatigue.

Even though those devices filtered hazardous gases, e.g., mercury vapor, from the crushed fluorescent light bulbs before emitting them from the housings to the open air, inadequate management of such filters may cause social concerns and problems.

None of the above patents provided a machine of exceptionally simple and inexpensive construction that could disintegrate flourescent light bulbs and retain such disintegrated material in a convenient container for safe disposal. Even with the two, above-identified patented improvements of a cylindrical fluorescent light bulb disposal apparatus, by Dana Emmerson, it is still desirable to provide an even more exceptionally simple and inexpensive machine that could disintegrate hazardous fluorescent light bulbs and retain such fluorescent material in a convenient container for environmentally-safe disposal.

SUMMARY OF THE INVENTION (a) Aims of the Invention

Accordingly, it is a first object of this invention to provide a portable machine for the safe disintegration of cylindrical fluorescent light bulbs.

A second object of this invention is to provide a portable, relatively light-weight, easily-and-safely-operable such machine.

A third object of this invention is to provide such a portable disposal machine, which will effectively disintegrate cylindrical fluorescent light bulbs.

A fourth object of this invention is to provide such a portable machine in which the exhausts therefrom satisfy environmental protection concerns.

A fifth object of this invention is to provide a novel filter system for such portable disposal machine.

A sixth object this invention is to provide such a portable disposal machine having improved means to disintegrate or crush the fluorescent light bulbs.

A seventh object of this invention is to provide a novel safety override system to prevent overfilling of the glass-filled disposable bag.

An eighth object of this invention is to improve the structures of the above-described rotating hammers, and to seal not only the crushed materials but also the hazardous gases, e.g., mercury vapor, from the crushed fluorescent light bulbs without emitting such gases to the open air.

(b) Statements of Invention

This invention provides an improvement in an apparatus for the disposal of fluorescent light bulbs including a chute for feeding fluorescent light bulbs. That apparatus includes into a sealed fluorescent light bulb crushing or disintegration shroud, a filter system to prevent discharge of toxic vapors to the atmosphere, and disposable means for collecting crushed fluorescent light bulbs. The improvement consists of an improved fluorescent light bulb crushing system which includes a motor shaft, and a securement member attached to the shaft. A pair of rigid articulated crushing hammers is secured to opposed ends of the securement means, by means of a chain-type joint. Each rigid articulated crushing hammer includes an arm and a weighted end, which is secured to the end of its associated arm by a chain-type joint.

This invention also provides another improvement in an apparatus for the disposal of fluorescent light bulbs. That apparatus includes a chute for feeding fluorescent light bulbs into a sealed fluorescent light bulb crushing or disintegration shroud a filter system to prevent discharge of toxic vapors to the atmosphere, and disposable means for collecting crushed fluorescent light bulbs. This another improvement consists of an improved toxic vapor filter system which includes a gas processing system comprising an upper gas-processing chamber and a lower gas-processing chamber. A system of exhaust tubes connects the interior of the shroud and the interior of the fluorescent light bulb feed tube to the interior of the upper gas-processing chamber. Three filters are connected in series between the upper gas-processing chamber, the lower gas-processing chamber and the shroud. The upper gas-processing chamber is separated from the lower gas-processing chamber by the primary filter. A system is provided for drawing toxic vapors through the primary filter from the upper gas-processing chamber to the lower gas processing system. A system of tubes interconnects the lower gas-processing chamber and the interior of the shroud via the secondary filter and the tertiary filter.

This invention also provides yet another improvement in an apparatus for the disposal of fluorescent light bulbs. That apparatus includes a chute for feeding fluorescent light bulbs into a sealed fluorescent light bulb crushing or disintegration shroud, a filter system to prevent discharge of toxic vapors to the atmosphere, and disposable means for collecting crushed fluorescent light bulbs. That yet another improvement consists both of an improved fluorescent light bulb crushing system, and an improved toxic filter system. The improved fluorescent bulb crushing system includes a motor having a shaft, and a securement member attached to the shaft. A pair of rigid articulated crushing hammers is secured to opposed ends of the securement member by means of a chain-type joint. Each rigid articulated crushing hammer includes an arm and a weighted end which is secured to the end of its associated arm by a chain-type joint. The improved toxic filter system includes a gas processing system comprising an upper gas-processing chamber and a lower gas-processing chamber and a system of exhaust tubes connecting the interior of the shroud and the interior of the fluorescent light bulb feed tube to the interior of the upper gas-processing chamber. Three filters are connected in series between the upper gas-processing chamber, the lower gas-processing chamber and the shroud. The upper gas-processing chamber is separated from the lower gas-processing chamber by the primary filter. A system is provided for drawing toxic vapors through the primary filter from the upper gas-processing chamber to the lower gas processing system. A system of tubes interconnects the lower gas-processing chamber and the interior of the shroud via the secondary filter and the tertia filter.

(c) Other Features of the Invention

Other features of the invention include the following improvements, either singly or in combination:

(a) the securement member comprises a ring which is secured to the free end of said shaft;

(b) each arm of the rigid hammer is secured to the ring by means of elastic clips;

(c) the upper filtration system is embodied as an enclosed filter sub-unit;

(d) the enclosed filter sub-unit includes a hingedly-mounted, access end wall;

(e) the system for drawing the toxic vapors through the primary filter consists of a vacuum generator which includes a motor for driving a suction fan, especially where the motor is an electric motor;

(f) the filter system includes an inlet aperture leading to an upper area of the enclosed filter sub-unit, and an outlet aperture leading from a lower area of the enclosed filter sub-unit;

(g) the system of exhaust tubes includes a secondary exhaust tube leading from an outlet of the primary filter means and a tertiary exhaust tube which is indirectly connected between an outlet of the secondary exhaust tube and the outlet aperture to the shroud, the secondary exhaust tube and the tertiary exhaust tube being disposed entirely within the enclosed filter sub-unit;

(h) an outlet of the secondary exhaust tube is indirectly connected to an inlet of the tertiary exhaust tube by means of a hingedly-mounted end wall;

(i) the system of exhaust tubes includes a primary exhaust tube which is connected between the open fluorescent bulb feeding chute and the inlet to the filter sub-unit;

(j) the aperture leading from the lower area of the enclosed filter unit leads to the fluorescent light bulb crusher shroud;

(k) the outlet end of the open cylindrical chute is connected to the inlet end of the primary exhaust tube;

(l) the primary filter means comprises a squareparallelepiped filter pad;

(m) the filter pad is disposed in a plane which is parallel to the plane of the secondary exhaust tube and to the plane of the tertiary exhaust tube;

(n) the filter pad comprises a carbon particle filter to trap mercury vapor and phosphor;

(o) the secondary filter comprises HEPA filters;

(p) the tertiary filter comprises a mercury filter;

(q) the support means for the disposable bag comprises a weigh scale;

(r) the weigh scale includes override means to prevent the operation of the rotatably-driven hammer when a predetermined weight of waste material is detected in the bag; and (s) the override means comprises a microswitch which is operatively associated with the weigh scale.

(d) Generalized Description of the Invention

In other words, this invention provides a rigid articulated hammer as a crushing member. Articulated joints are provided in the arms of the rigid articulated hammer, and are structured in the rigid articulated hammer so that, when the rigid articulated hammer hits a metal end piece of fluorescent light bulb, the impact will be reduced by bending of the rigid articulated hammer at chain-type joints, and subsequent recovery to its extended positions due to the centrifugal force.

Furthermore, the entire tubular system from the feed tube to the shroud that has the rotatable rigid articulated hammer structure described above, to the collecting bag, is completely contained within the housing. Vapors which are emitted from the fluorescent light bulbs are separately treated by three filters in series to become harmless within the housing, are returned to the upper section of the shroud, and a portion thereof is kept with the crushed materials inside the sealed bag.

BRIEF DESCRIPTION OF THE FIGURES

In the accompanying drawings.

Figure 1:
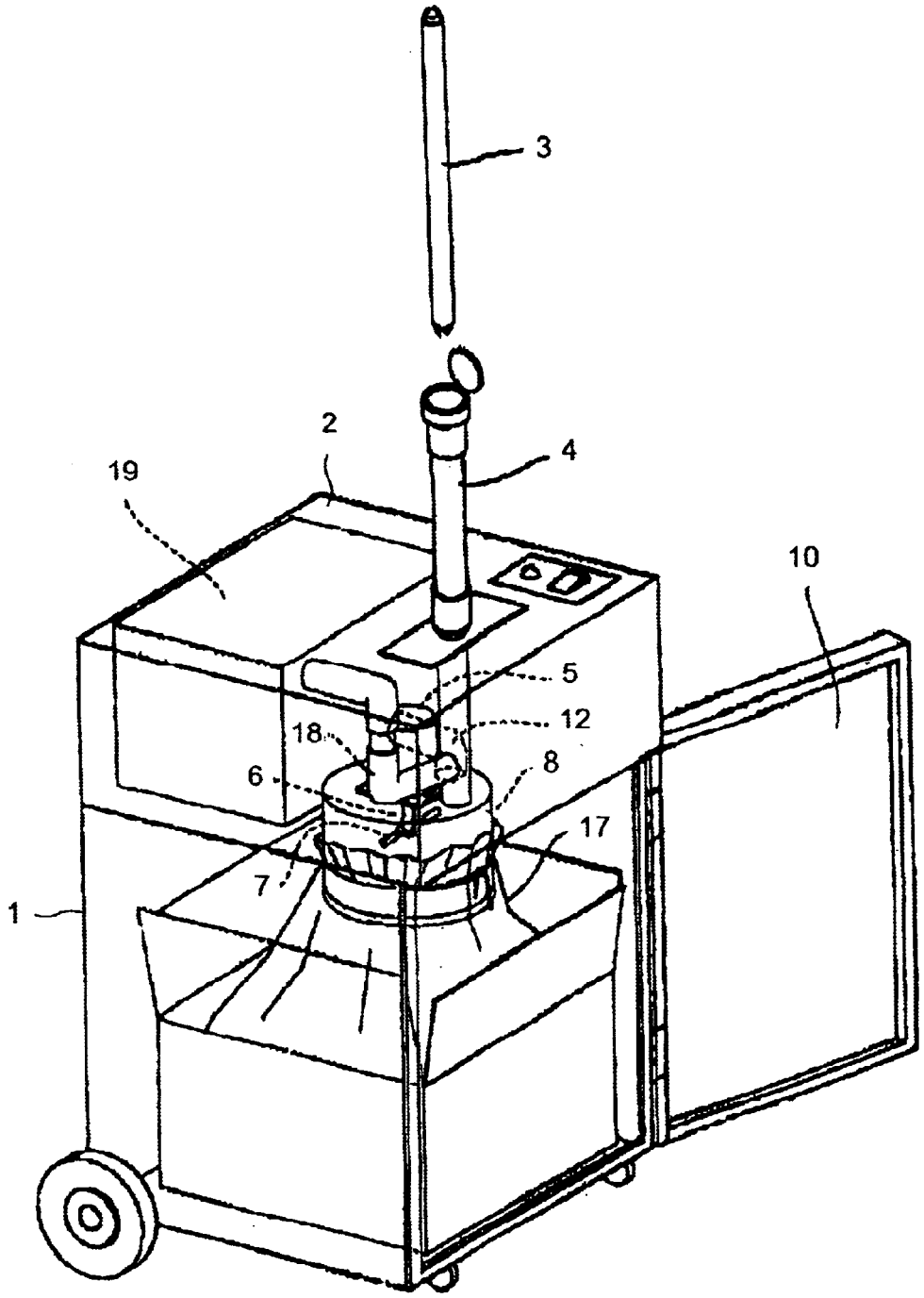
FIG. 1 is a perspective view of one embodiment of the bulb disposal apparatus according to this invention.

DESCRIPTION OF PREFERRED EMBODIMENTS (a) Description of FIG. 1

As shown in FIG. 1, the bulb disposal apparatus includes a housing 1, which is in the form of a rectangularparallelepiped, and this includes a top surface 2. A fluorescent light bulb feed tube 4 is secured to the top surface 2 and extends downwardly into the shroud 8 of the bulb crusher.

Figure 2:
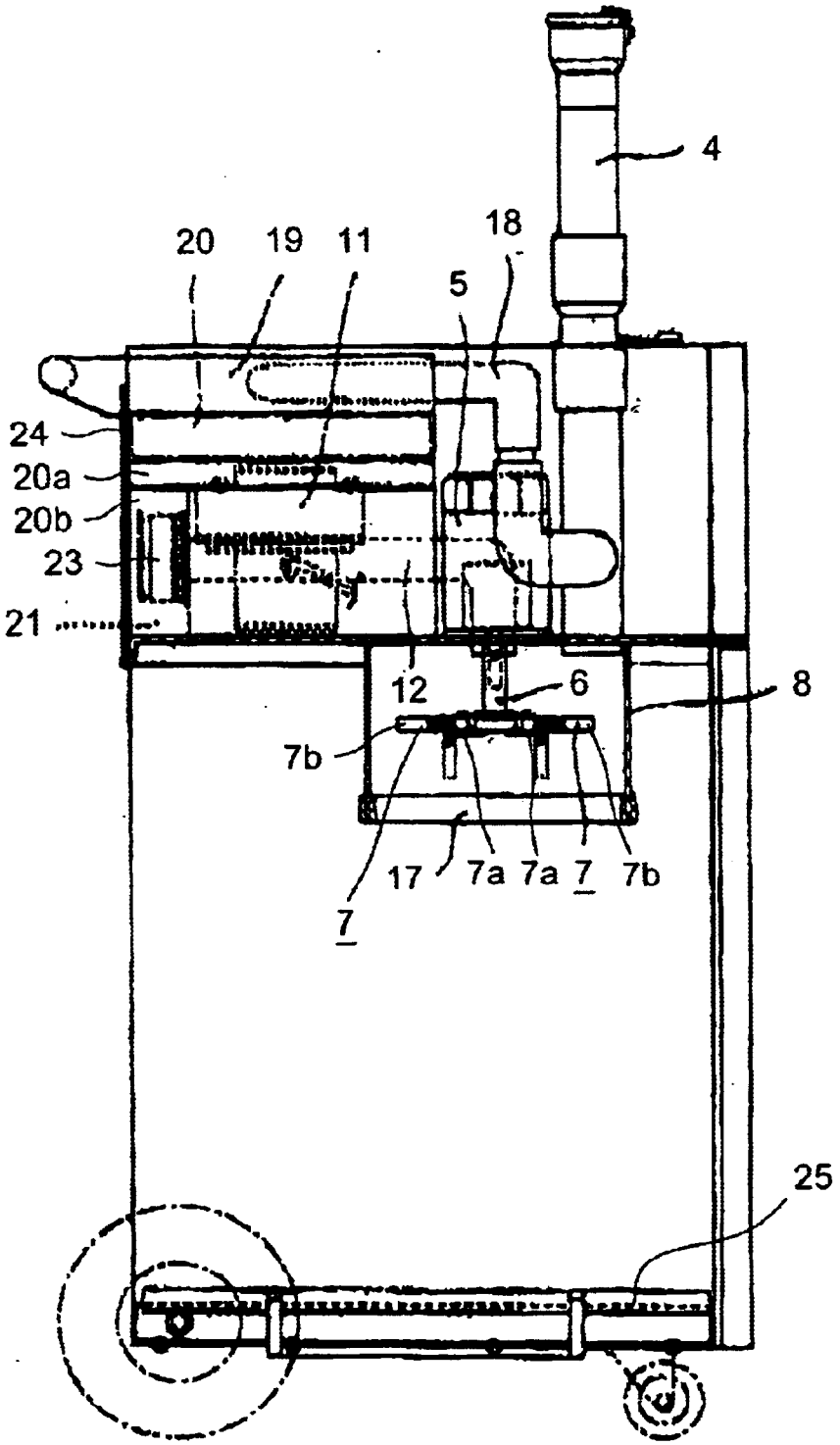
FIG. 2 is a central longitudinal cross-section of the bulb disposal apparatus shown in FIG. 1.
Figure 3:
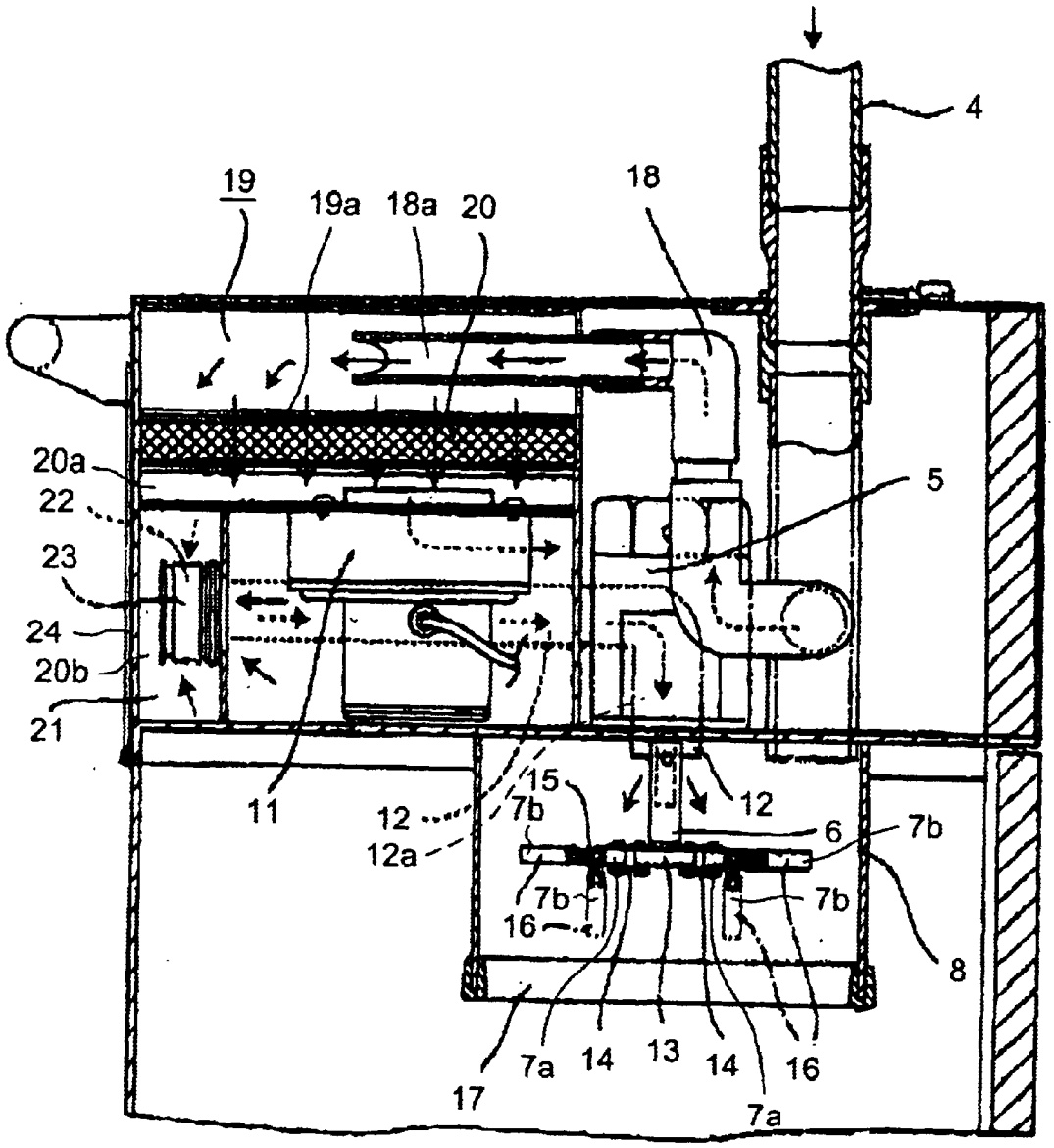
FIG. 3 is an enlarged central longitudinal cross-section of the upper portion of the bulb disposal apparatus shown in FIG. 1.
Figure 5:
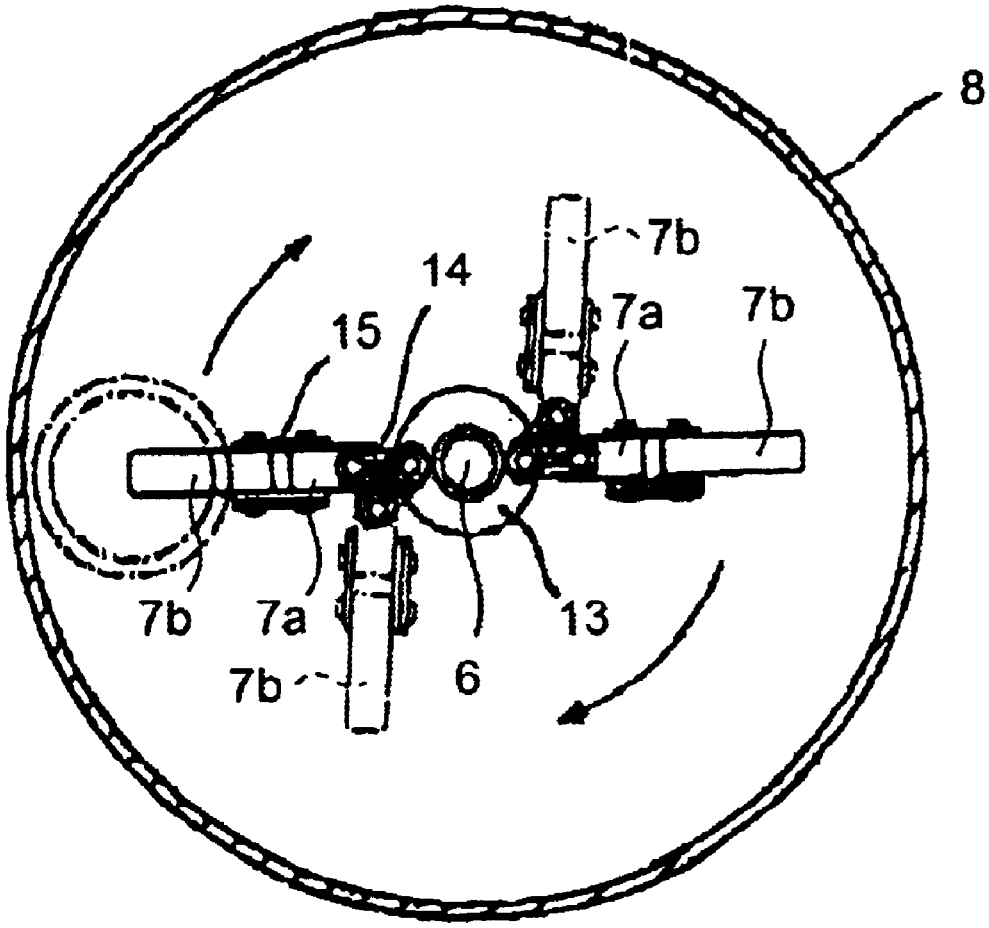
FIG. 5 is a sectional view, looking upwardly of the shroud and bulb crushing hammer of the bulb disposal apparatus shown in FIG. 1.

(b) Description of FIG. 2, FIG. 3 and FIG. 5

As seen in FIG. 2, FIG. 3 and FIG. 5, within the shroud 8 is the shaft 6 of a motor 5. A securement ring 13 is secured to the shaft 6. A pair of rigid articulated crushing 1 hammers 7 is pivotally-secured to diametrically-opposed areas of the securement ring at joints which are similar to chains. Each articulated crushing hammer 7 includes a main arm 7*a*, which is pivoted to the securement ring at joint 14 which is similar to a chain, and a downwardly-depending arm 7*b* including weight 16, which is pivotally attached to the main arm at joint 15 which is similar to a chain. A suitable disposable bag 17, e.g., of a plastic material, is hermetically-secured to the open bottom of the shroud 8, to be fitted within a box 9, e.g., of cardboard, in the bottom portion of the housing. Access to the bag 17 and the box 9 is by way of hinged door 10.

The upper portion of the housing 1 of the fluorescent light bulb disposal apparatus includes a chamber, for accommodating the motor 5 and the fluorescent light bulb feed tube 4, and a gas-processing system including an upper gas-processing chamber 19 and a lower gas-processing chamber 21.

The fluorescent light bulb feed tube 4 is open to the shroud 8 and is connected via a diverging tube system 18 to the interior of the upper gas-processing chamber 19. Three filters are connected in series between the upper gas-processing chamber, the lower gas-processing chamber and the shroud. The primary filter 20, e.g., a carbon particle filter, is disposed in the upper gas-processing chamber 19. A blower 11 is provided with an inlet to suck vapors from the diverging tube system 18 through the primary filter 20 and to the return air loop system 12. Blower 11 thus acts as a vacuum generator by means of an electric motor 11*a* which drives a conventional suction fan 11*b*. The return air loop system includes a first tube 18*a* which is open at its top to draw vapors thereinto from the primary filter 20. The return loop includes the secondary filter 22, e.g., a HEPA filter and the tertiary filter, e.g., a mercury filter 23.

Figure 4:
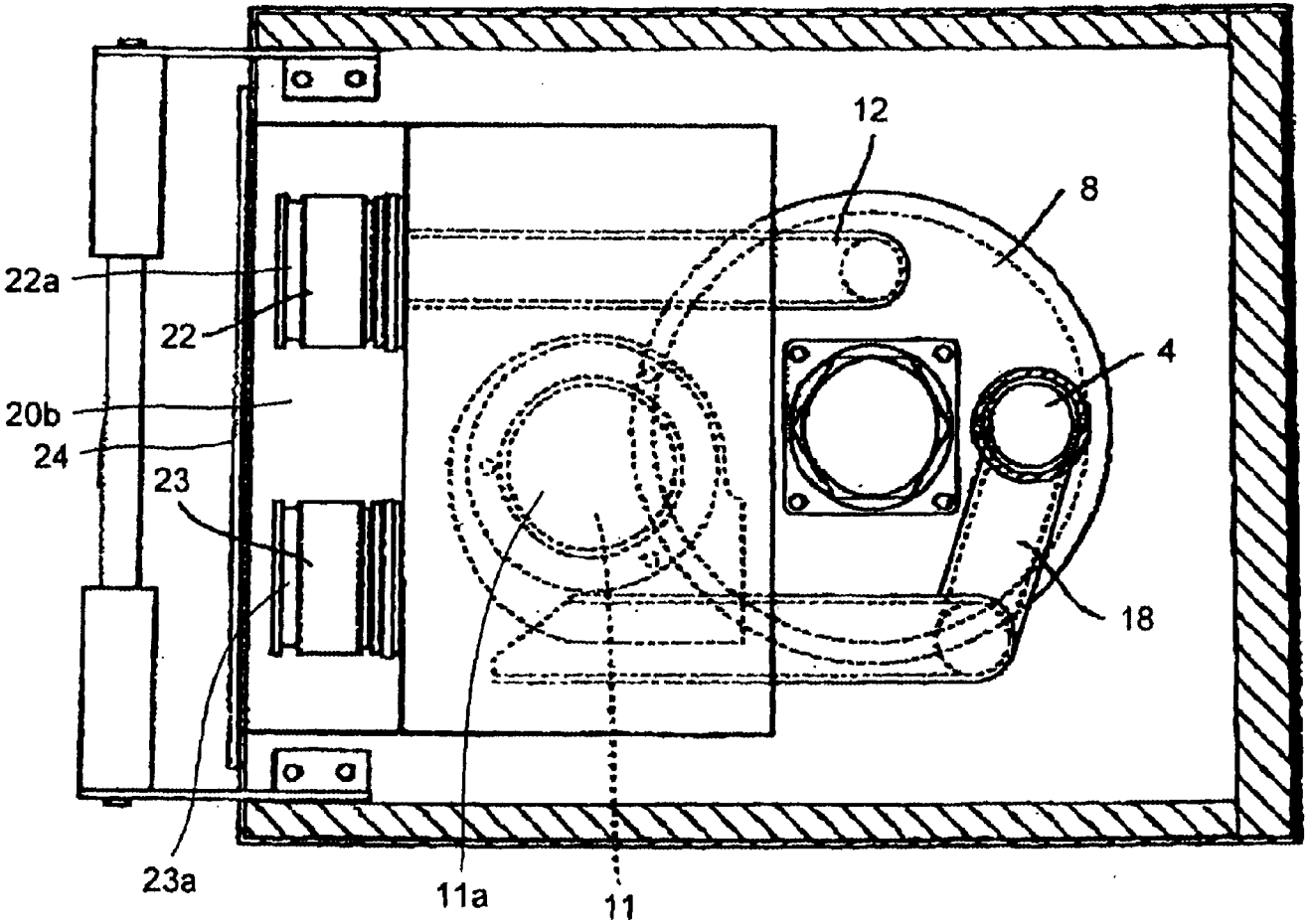
FIG. 4 is a transverse cross-section of the upper part of the bulb disposal apparatus shown in FIG. 1.

(c) Description of FIG. 3, FIG. 4 and FIG. 5

The details of the rotatable hammer assembly are shown in FIGS. 3 and 5. The motor shaft 6 extends downwardly in parallel with the feed tube 4. A ring 13 is installed 61 on the tip of the shaft 6, and a hammer assembly is symmetrically extended from the ring 13. The hammer assembly has two arms 7*a*, 7*b* and two articulated joints 14, 15 per arm. The joint 14 closer to the motor shaft 6 bends in the horizontal direction, while the other joint 15 which is further from the shaft 6 bends in the vertical direction. Commonly available chain-type joints are used for the joints 14 and 15.

FIG. 3 shows the relation between the fluorescent light bulb 3 and the vertical joints 15. When the metal end of a fluorescent light bulb 3 hits the arm tip weights 16 of the rotating rigid articulated hammer 7, the impact is relieved by way of the arm tip 16 momentarily bending down vertically at the joint 15 as shown by the dotted line in FIG. 3. When the impact is relieved, additional load is momentarily added to the rotation of the motor 5. In order to ease the load, the rigid hammer 7 momentarily further bends in a vertical direction as shown by the dotted line in FIG. 3.

Operation of the Invention

In operation, a fluorescent light bulb 3 is fed through the feed tube 4 that stands vertically on the top surface 2 of the housing 1. The upper section of the shroud 8 is from their bottom to their top by the horizontally-rotating rigid articulated hammer 7 that is installed symmetrically on the shaft 6 of the motor 5. The debris is collected in the bag 17 that is tied to the lower section of shroud 8. The bag 17 is placed inside the box 9, and can be removed along with the box through the door 10.

Hazardous gases, e.g., mercury vapors from the fluorescent bulb, that are emitted inside the shroud 8 are filtered three times through three filters arranged in series. Thus, these hazardous gases are drawn to the sealed-type, upper gas-processing chamber 19 via a tube system including the tube 18 diverging from the feed tube 4. Then, they are collected in the lower gas-processing chamber 21 after being cleaned by being drawn through the primary filter 20, (e.g., an activated carbon filter) that partitions the upper gas-processing chamber 19 and lower gas-processing chamber 21. The hazardous gases are then further filtered through the secondary filter 22, and the tertiary filter 23 and are returned to the upper section of the shroud 8 via the return air tube 12.

In more specific terms, the vapors are filtered three times by passing through a three series-connected filters. The vapors which are drawn into the return air loop system from the primary filter 20 are expelled via second tube 22*a* through secondary filter 22, e.g., a HEPA filter. The vapors are then drawn via third tube 23*a* through tertiary filter 23, e.g., a mercury filter, into the final tube 12*a* of the return air loop system 12. The vapors within return via loop system 12 are discharged into shroud 8, a portion of the vapors being recycled, while the remainder of the vapors are discharged into the bag 17. Access to the filters 20, 22, 23 is by way of hinged door 24. Hinged door 24 also acts as a rebound surface to redirect vapors from tube 22*a* to tube 23*a* via space 22*b*. (See FIG. 4)

In its crushing operation, when the motor S is rotated, the rotating rigid articulated hammer 7 extends radially-outwardly by centrifugal force to impinge upon, and crush, the fluorescent light bulbs into finely divided glass dust while releasing mercury and other toxic vapors. The mercury and other toxic vapors are filtered three times by passing through three series-connected filters. The toxic vapors are drawn up the fluorescent light bulb feed tube 4 and into the tube system including tube 18 into the upper gas-processing chamber 19. The toxic vapors are drawn through the primary filter 20 by the suction of the blower 11 and fan ha and pass out through secondary filter 22 and into tertiary filter 23 and are then expelled through the tertiary filter 23 into shroud 8 via return air tube system 12. A portion of the toxic gases is then recycled through the above-described filter system, while the remainder of the gases are fed into the bag 17, along with the finely divided glass particles to be disposed of by insertion of the filled bag 17 into the disposal box 9.

In more general terms, the hazardous gases which are formed within the shroud 8 are drawn upwardly into the sealed upper gas-processing chamber 19 via the diverging tube system 18 and is then filtered three times, firstly through the primary filter 20, and are accumulated in the lower gas-processing chamber 21. The gases are then further filtered a second time through secondary filter 22 and a third time through tertiary filter 23, and are returned to the upper area of the shroud via the return arm tube system 12.

Other Characterizations of the Invention

As described above, this invention is characterized by the introduction of the relief in the rotatable hammer structure in order to ease the impact and load to extend the life of the hammer assembly. Also the motor will not overheat even though it is contained in a sealed area. Even if the rotatable hammer assembly is worn out, it is very easy to replace, as the chain-type joints 14 and 15 are simply attached by the means of elastic clips (not seen). Furthermore, the motions of the chain-type joints will not be harmed as clean air blowing onto the chain-type joints 14 and 15 from the return air tube 12 and the chain-type joints are kept free from the deposit of debris, e.g., fluorescent membranes.

The present invention may also provide a novel cut-off system to assure that the crushing of the fluorescent light bulbs does not occur if the disposable bag 17 is full. In the past, this had been done by means of a counter which was associated with the inlet tube 4 on the assumption that there was an average number of tubular fluorescent light bulbs which, when crushed, would "fill" the bag. This was not accurate for two reasons, namely: firstly, the size of the tubular fluorescent light bulbs was not uniform; and secondly, the size of the disposable bags 17 was not uniform. The present invention solves that problem.

By an embodiment of the invention, the empty disposable bag 17 which is within the box 9 rests upon a conventional weigh scale system 25. The weigh scale system 25 includes suitable means, e.g., a microswitch (not seen), which is adjusted so that, when the weight of the bag 17/box 9 reaches a predetermined value which represents a full bag 17, the microswitch overrides the on/off switch to motor 5, thereby preventing further operation of the machine.

As described above, the present invention also includes a particular fluorescent light bulb crusher system. In accordance with an embodiment of the present invention, the fluorescent light bulb crusher system comprises a ring/loop 13 which is secured to the shaft 6 of the motor 5. The rotatable rigid articulated hammer 7 includes two arms 7*a*, 7*b*, each of which is pivotally-attached by a chain-type joint 14/15 to a diametrically-opposed sector of the ring/loop 13. Each arm 7*a*, 7*b* includes a downwardly-depending weight 16 which is secured to its associated arm by a chain-type joint 14/15. As the motor 5 rotates, the weights 16 are raised by centrifugal force to impact and crush the fluorescent bulbs 3. Because of the enhanced impact of the weighted arms 7*a*, 7*b* which contact the fluorescent light bulb at 90° to the downward movement of the fluorescent light bulb, the fluorescent light bulbs are broken rapidly into small particles. The rugged construction of the rigid articulated hammer 7 greatly lengthens the useful life of the fluorescent light bulb crusher system. The internal recycling exhaust system 12, 18 which draws vapors through the three replaceable filters arranged in series greatly minimizes any discharge of undesirable hazardous materials into the environment. In addition, the lower weigh scale system 25 which supports the disposable bag 17, prevents overfilling of the disposable bag 17 with crushed glass.

Conclusion

Variations can be made in the above-described preferred embodiment, as will be understood by one skilled in the art. The motor, the inlet chute, and the switch can, of course, be mounted in other arrangements than that specifically shown. The motor can be other than electric, e.g., pneumatic or hydraulic. The inlet chute can be a single tube. Alternatively, the inlet chute can comprise two separate tubes, if desired. Types of glass (or other material) tubes other than fluorescent bulbs can also, of course, be disposed of by the apparatus of the present invention, by suitable modification to the inlet means.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What is claimed is:

1. In an apparatus for the disposal of fluorescent light bulbs including a chute for feeding fluorescent light bulbs into a sealed fluorescent light bulb crushing or disintegration shroud, a filter system to prevent discharge of toxic vapors to the atmosphere, and disposable means for collecting crushed fluorescent light bulbs, the improved fluorescent light bulb crushing system comprising:

a motor having a shaft;

a securement member attached to said shaft; and a pair of rigid articulated crushing hammers secured to opposed ends of said securement member, by means of a chain-type joint, each said rigid articulated crushing hammer including a weighted end and an associated arm, said weighted end being secured to the end of said associated arm by a chain-type joint.

2. The apparatus as claimed in claim 1, wherein said securement member comprises a ring which is secured to the free end of said shaft.

3. The apparatus as claimed in claim 2, wherein said arm of said rigid articulated crushing hammer is secured to said ring by means of elastic clips.

4. The improvement as claimed in claim 1, and including the further improvement comprising: weigh scale means which is operatively connected to said bulb crushing system motor for overriding said bulb crushing system motor when the weight within said disposable bag means indicates that said bag is full.

5. The improvement as claimed in claim 4, wherein said weigh scale includes override means to prevent the operation of the rotatably-driven bulb crusher motor when a predetermined weight of material is detected in said bag.

6. The improvement as claimed in claim 5, wherein said override means comprises a microswitch which is operatively associated with said weigh scale.

7. In an apparatus for the disposal of fluorescent light bulbs including a chute for feeding fluorescent light bulbs into a sealed fluorescent light bulb crushing or disintegration shroud, a filter system to prevent discharge of toxic vapors to the atmosphere, and disposable means for collecting crushed fluorescent light bulbs, the improved toxic vapor filtration system comprising:

a gas processing system comprising an upper gas-processing chamber and a lower gas-processing chamber;

a system of exhaust tubes connecting the interior of said shroud and the interior of said fluorescent light bulb feed tube to the interior of said upper gas-processing chamber;

three filters connected in series between said upper gas-processing chamber and said shroud, said three filters consisting of a primary filter, a secondary filter and a tertiary filter;

said upper gas-processing chamber being separated from said lower gas-processing chamber by said primary filter;

a system for drawing toxic vapors through said primary filter from said upper gas-processing chamber to said lower gas-processing chamber; and a system of tubes interconnecting said lower gas-processing chamber and the interior of said shroud via said secondary filter and said tertiary filter.

8. The improvement as claimed in claim 7, wherein said upper gas-processing chamber is embodied as an enclosed filter sub-unit.

9. The improvement as claimed in claim 8, wherein said enclosed filter sub-unit includes a hingedly-mounted access end wall.

10. The improvement as claimed in claim 7, wherein said system for drawing toxic vapors through said primary filter comprises a vacuum generator which includes a motor for driving a suction fan.

11. The improvement as claimed in claim 10, wherein said motor comprises an electric motor.

12. The improvement as claimed in claim 7, wherein said system of exhaust tubes includes a secondary exhaust tube leading from an outlet of said primary filter and a tertiary exhaust tube which is indirectly connected from an outlet of said secondary exhaust tube and from said outlet aperture to said shroud, said secondary exhaust tube and said tertiary exhaust tube being disposed entirely within said enclosed filter sub-unit.

13. The improvement as claimed in claim 12, wherein an outlet of said secondary exhaust tube is indirectly connected to an inlet of said tertiary exhaust tube by means of rebounding off a hingedly-mounted access end wall.

14. The improvement as claimed in claim 12, wherein said secondary filter comprises HEPA filters.

15. The improvement as claimed in claim 12, wherein said tertiary filter includes a mercury filter.

16. The improvement as claimed in claim 7, wherein said primary filter means comprises a squareparallelepiped filter pad.

17. The improvement as claimed in claim 16, wherein said filter pad is disposed in a plane which is parallel to the plane of said secondary exhaust tube and to the plane of said tertiary exhaust tube.

18. The improvement as claimed in claim 16, wherein said filter pad comprises a carbon particle filter to trap mercury vapor and phosphor.

19. In an apparatus for the disposal of fluorescent light bulbs including a chute for feeding fluorescent light bulbs into a sealed fluorescent light bulb crushing or disintegration shroud, a filter system to prevent discharge of toxic vapors to the atmosphere, and disposable means for collecting crushed fluorescent light bulbs, the improvement comprising:

(I) an improved fluorescent light bulb crushing system comprising:

a motor having a shaft;

a securement member attached to the shaft; and a pair of rigid articulated crushing hammers secured to opposed ends of said securement member, by means of a chain-type joint, each said rigid articulated crushing hammer including a weighted end and an associated arm, said weighted end being secured to the end of said associated arm by a chain-type joint; and (II) an improved toxic vapor filtration system comprising:

a gas processing system comprising an upper gas-processing chamber and a lower gas-processing chamber;

a system of exhaust tubes connecting the interior of said shroud and the interior of the fluorescent light bulb feed tube to the interior of said upper gas-processing chamber;

three filters connected in series between said upper gas-processing chamber and said shroud, said three filters consisting of a primary filter, a secondary filter and a tertiary filter;

said upper gas-processing chamber being separated from said lower gas-processing chamber by said primary filter;

a system for drawing toxic vapors through said primary filter from said upper gas-processing chamber to said lower gas-processing chamber; and a system of tubes interconnecting said lower gas-processing chamber and the interior of said shroud via said secondary filter and said tertiary filter.

20. The improvement as claimed in claim 19 and including the further improvement comprising:

weigh scale means which is operatively connected to said bulb crushing system motor for overriding said bulb crushing system motor when the weight within said disposable bag means indicates that said bag is full.

21. The improvement as claimed in claim 20, wherein said weigh scale includes override means to prevent the operation of the rotatably-driven bulb crusher motor when a predetermined weight of material is detected in said bag.

22. The improvement as claimed in claim 21, wherein said override means comprises a microswitch which is operatively associated with said weigh scale.

* * * * *